US006878010B2

(12) United States Patent
Ke et al.

(10) Patent No.: US 6,878,010 B2
(45) Date of Patent: Apr. 12, 2005

(54) CABLE END CONNECTOR ASSEMBLY WITH AN IMPROVED PULLING DEVICE

(75) Inventors: Yun-Long Ke, Tu-chen (TW); Chin Pao Kuo, Tu-chen (TW); Zhen-Da Hung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/856,089

(22) Filed: May 28, 2004

(65) Prior Publication Data

US 2004/0242051 A1 Dec. 2, 2004

(30) Foreign Application Priority Data

May 28, 2003 (TW) ..... 92209836 U

(51) Int. Cl.[7] ..... H01R 13/00
(52) U.S. Cl. ..... 439/483
(58) Field of Search ..... 439/483, 484

(56) References Cited

U.S. PATENT DOCUMENTS 4,379,361 A 4/1983 Webster
4,881,911 A * 11/1989 Haddock et al. ..... 439/484
5,446,622 A * 8/1995 Landry et al. ..... 361/737
6,416,354 B1 * 7/2002 Lee ..... 439/484
6,705,885 B1 * 3/2004 Lin et al. ..... 439/476.1
6,783,387 B1 * 8/2004 Lin et al. ..... 439/483

* cited by examiner

*Primary Examiner*—Phuong Dinh
(74) *Attorney, Agent, or Firm*—Wei Te Chung

(57) ABSTRACT

A micro coaxial cable end connector assembly comprises an insulative housing (10), a plurality of contacts (20) received in the housing, a plurality of cable wires (30) connecting the contacts, a shell portion (4) enclosing the insulative housing, and a pulling device (60) connecting the shell. The pulling device has a connective ring and a pulling belt. The connective ring comprises a body and a pair of connecting portions, the connecting portions being connected to opposite sides of the shell portion respectively. The pulling belt comprises a surrounding portion surrounding the body of the connective ring and a pulling portion extending along a direction opposite to the mating section of the insulative housing.

9 Claims, 3 Drawing Sheets

CABLE END CONNECTOR ASSEMBLY WITH AN IMPROVED PULLING DEVICE

BACKGROUND OF THE INVENTION

1. Field of the Invention

The present invention relates to a cable end connector assembly, and more particularly to a cable end connector assembly having a pulling device means to prevent a damage when the cable end connector is departed from a complementary connector.

2. Description of Prior Art

Micro coaxial cable end connector assembly is commonly used to transmit high speed signals and the profile is smaller than a typical cable end connector assembly. To facilitate removing the cable end connector assembly from connection with the complementary connector, pull mechanisms have been used. Such pull mechanisms generally permit applying a withdrawing force to the cable end connector assembly without pulling a cable of the cable end connector assembly.

U.S. Pat. No. 4,379,361 (the 361 patent) discloses one type of full mechanism. In conjunction with FIG. 3 of the '361 patent, a cable end connector assembly 1 has a pull tab 50 partially inserted in a connector body 9 of the assembly 1 between two rows of contacts 7 of the assembly 1 for user pinching and pulling when the assembly 1 is to be disengaged from a complementary connector. However, to comply with miniaturization trends in the electronic filed, the cable end connector assembly is required to be manufactured much smaller than before. Due to the pulling tab is over-molded with a rear end of the insulative housing. Therefore, the process of assemblies are too complex to mate the requirements of small profile.

Hence, a micro coaxial cable end connector assembly with an improved pulling device is required to overcome the disadvantages of the prior art.

SUMMARY OF THE INVENTION

An object of the present invention is to provide a micro coaxial cable end connector assembly having a improve pulling device means for ensuring a good electrically connection and reducing cost of assemblies and manufacturing.

In order to achieve the objects set forth, a micro coaxial cable end connector assembly comprises an insulative housing, a plurality of contacts received in the housing, a plurality of cable wires connecting the contacts, a shell portion enclosing the insulative housing, and a pulling device connecting the shell.

The insulative housing has a mating section. The contacts are received in the insulative hosing. The cable wires connect the contacts. The shell portion encloses two sides of the insulative housing, and the pulling device has a connective ring and a pulling belt. The connective ring comprises a body and a pair of connecting portions, the connecting portions being connected to opposite sides of the shell portion respectively. The pulling belt comprises a surrounding portion surrounding the body of the connective ring and a pulling portion extending along a direction opposite to the mating section of the insulative housing.

Other objects, advantages and novel features of the invention will become more apparent from the following detailed description when taken in conjunction with the accompanying drawings.

DETAILED DESCRIPTION OF THE INVENTION

Figure 1:
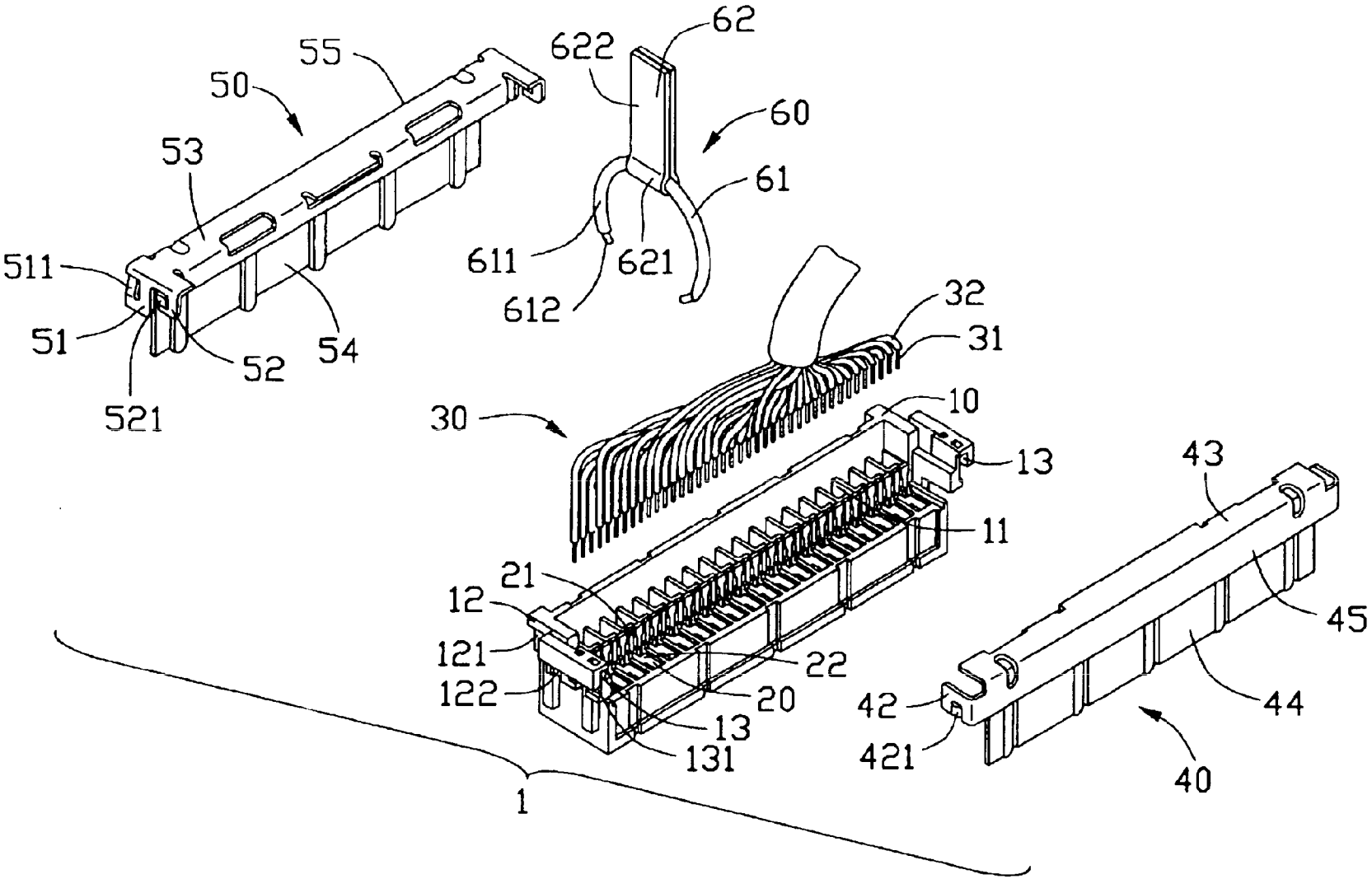
FIG. 1 is an exploded, assembled view of a micro coaxial cable end connector assembly in accordance with the present invention.
Figure 2:
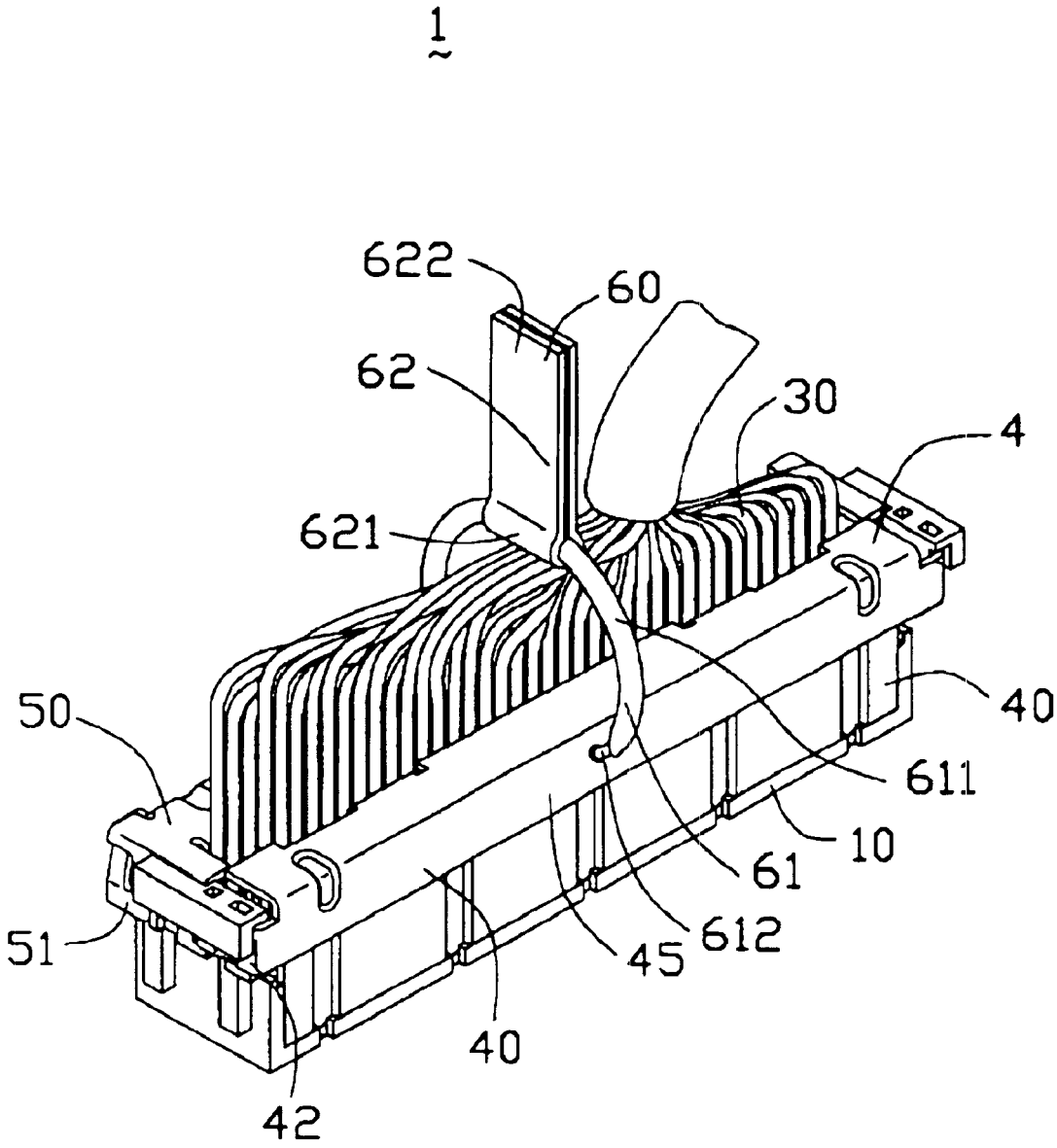
FIG. 2 is an assembled, perspective view of the micro coaxial cable end connector assembly of FIG. 1.

Referring to FIGS. 1 to 2, a cable end connector assembly 1 in accordance with the present invention includes an insulative housing 10, a plurality of contacts 20, a plurality of the cable wires 30, a shell portion 4, and a pulling device 60.

Figure 4:
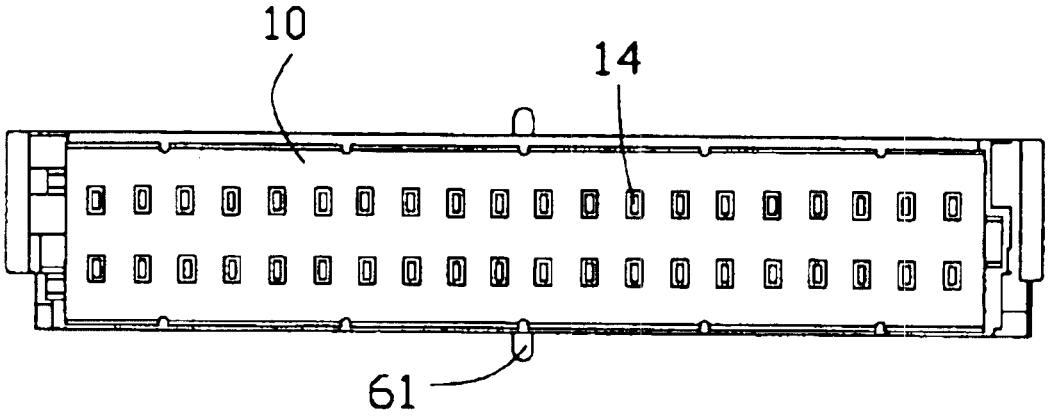
FIG. 4 is a view of a mating section of an insulative housing of the assembly taken from front aspect of FIG. 3.

The housing 10 is a rectangular-shaped, a top surface (not labeled) of the housing extends downwardly and defines a plurality of receiving space 11 receiving the contacts, referring to FIG. 4, a bottom surface (not labeled) of the housing defines a plurality cavities 14 communicating with the receiving space 11. Two opposite walls 121 are formed at the lateral ends of the housing, a pair of first step 12 are formed at the rear end of the opposite wall 121, the opposite walls 121 define a pair of recesses 13 at front end therein, each recess 13 projects a second step 131 in an inner surface thereof. The first step and the second step together define a depression 122.

The contacts are received in the corresponding receiving space 11, each contact 201 comprises a mating section 22 and a tail portion 21 extending rearwardly from the mating section 22.

Each conductor core 30 comprises a conductor wire 31 connecting the tail portion 21 of the contact 201 and a insulative jacket 32 enclosing the conductor wire 31.

Figure 3:
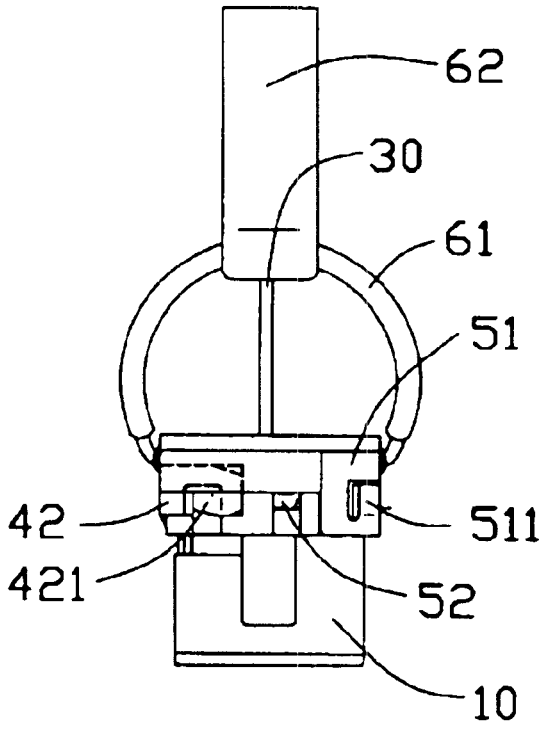
FIG. 3 is a part assembly view of a pulling device and shell portion of the assembly of FIG. 2 taken front aspect.

Referring to the FIG. 3. The shell portion 4 has a first and second shell 40, 50, the structures of the first and the second shell 40, 50 are similar, each shell 40, 50 comprises a top wall 43, 53, side walls 45, 55 extending outwardly from the top wall 43, 53, and a main portion 44, 54 extending downwardly from the side wall 45, 55. The first shell forms a pair of flange 42 at the lateral end of the side wall 45, each flange forms a resilient portion 421 bent inwardly thereof. A pair of first and second arms 51, 52 are formed at and extend downwardly from the lateral end of the top wall 53 of the second shell 50. Each first arm 51 forms an elastic plate 421 extending inwardly along a down-to-up direction. Each second arm forms a barb on the outer surface thereof. Each main portion 54, 44 forms a plurality of projections(not labeled) mating with corresponding indentations(not labeled) on the outer surface of the insulative housing.

The pulling device comprises a connective ring 61 and a pulling belt 62. The connective ring comprises a body 611 enclosed an insulative jacket(not labeled) and a connecting portion 612 extending inwardly beyond the insulative jacket. In this case, the pulling belt is a single conducting wire. The pulling belt 62 comprises a surrounding portion 621 surrounding a part of the connective ring 61 and a pulling portion 622 formed integral with the surrounding portion 621, the pulling portion 622 extends oppositely of the mating section 14 of the insulative housing 10.

Referring to FIGS. 1–4, in assembly, the contact set 20 is inserted into the receiving space 11 of the insulative housing 10. The tail portions 21 of the contacts 201 are soldered with the conductive wire 31 of the conductive core 30. The first shell 40 is assembled on the insulative housing 10 along a front-to-rear direction, the resilient portions 421 of the flanges 42 mate with the second step 131 of the insulative housing 10. The second shell 50 is assembled on the insulative housing 10 along an up-to-down direction, the elastic plates 511 of the first arms 51 mate with the first step 12 of the insulative housing 10, the second arms 52 mate with the depression 122 of the insulative housing 10.

The projections of the first and second shell 40, 50 mate with the indentations of the housing 10 for achieving a securely connection. The top walls 43, 53 of the first and second shell 40, 50 together define a channel the cable wires 30 extending throughthere. In alternately embodiment, the first and second shell also can be formed integrally and define a channel in a opposite side of the mating section 14 of the insulative housing 10.

The connecting portions 612 of the connective ring 61 of the pulling device 60 connect the first and second shell 40, 50 respectively. The body 611 of the connective ring 61 is soldered with an opposite side of the mating section 14 of the insulative housing, the ends of the connecting portions 612 of the connective ring 61 extend beyond the insulative jacket and be soldered on the side wall 45, 55 of the first and second shell 40, 50. The connecting portion 612 of the connective ring 61 also can be soldered on the main portion 44, 54 and top wall 43, 53 of the first and second shell 40, 50 as long as the connective ring 61 and the first and second shell 40, 50 can ensure a securely connection therebetween.

When the soldering process of the connective ring 61 and the first and second shell 40, 50 is completely, the connective ring 61 is semicircle-shaped. The connecting belt 62 has an adhesive surface to past and surround the upper end of the body 611 of the connective ring 61. In this case, the connective ring 61 connect the first, second shell 40, 50 at the central of the longitudinal side of the housing 10, and the pulling belt 62 is also secured at the central of the connective ring 61. When the cable end connector assembly 1 is pulled to depart the complementary connector, the entirety cable end connector 1 can get up a balance condition.

The structures of the pulling belt 62 and the connective ring 61 of the pulling device 60 are simplified so that cost of the manufacturing and assemblies can be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

an insulative housing having a mating section;

a plurality of contacts received in the insulative hosing;

a plurality of cable wires connecting the contacts;

a shell portion enclosing at two sides of the insulative housing; and a pulling device having a connective ring and a pulling belt, the connective ring comprising a body and a pair of connecting portions, the connecting portions being connected to opposite sides of the shell respectively, the pulling belt comprising a surrounding portion surrounding the body of the connective ring and a pulling portion extending along a direction opposite to the mating section of the insulative housing; wherein the connective ring is approximately semicircle-shaped, the surrounding portion of the pulling belt is positioned at a center of the connective ring; wherein the connective ring further comprises an insulative jacket enclosing the body of the connective ring, the connecting portion extending inwardly beyond the insulative jacket; wherein the pulling belt is rectangular-shaped and has at least one adhesive surface; wherein the pulling portion of the pulling belt is made by folding up and pasting the adhesive surface.

2. The cable end connector assembly as claimed in claim 1, wherein the shell portion comprises a first and second shells, each shell has a side wall enclosing the side of the insulative housing and a top wall extending upwardly and bent inwardly from the side wall.

3. The cable end connector assembly as claimed in claim 2, wherein the connecting portions of the connective ring connect the side walls of the first and second shell, respectively.

4. The cable end connector assembly as claimed in claim 3, wherein the connecting portions of the connective ring are soldered to centers of the side walls of the first and second shells, respectively.

5. The cable end connector assembly as claimed in claim 4, wherein the cable wires extend through a channel defined by the top walls of the first and second shells.

6. The cable end connector assembly as claimed in claim 1, wherein the shell is formed integral and comprises side walls enclosing the sides of the insulative housing and top walls extending upwardly and bent inwardly from the side walls.

7. The cable end connector assembly as claimed in claim 6, the connecting portions of the connective ring connect the side walls of the first and second shells, respectively.

8. The cable end connector assembly as claimed in claim 7, wherein the connecting portions of the connective ring are soldered to centers of the side walls of the first and second shells, respectively.

9. The cable end connector assembly as claimed in claim 8, wherein the cable wires extend through a passageway defined by the top walls of the shells.

* * * * *